US008567708B2

(12) United States Patent
Shimp et al.

(10) Patent No.: US 8,567,708 B2
(45) Date of Patent: Oct. 29, 2013

(54) PORTABLE BOBBIN WINDER

(75) Inventors: Rosemary Shimp, Nolensville, TN (US); Kenneth Hatcher, Smyrna, TN (US); David Sasur, Ludlow, MA (US)

(73) Assignee: Simplicity Pattern Co. Inc., Antioch, TN (US)

( * ) Notice: Subject to any disclaimer, the term of this patent is extended or adjusted under 35 U.S.C. 154(b) by 401 days.

(21) Appl. No.: 13/069,660

(22) Filed: Mar. 23, 2011

(65) Prior Publication Data

US 2012/0241546 A1 Sep. 27, 2012

(51) Int. Cl.
*D05B 59/00* (2006.01)
*B65H 75/40* (2006.01)
*B65H 75/34* (2006.01)

(52) U.S. Cl.
USPC ..... 242/578; 242/419.4; 242/485.1; 242/485.5; 242/486.7; 242/486.8; 242/487.1; 242/597.7; 242/128; 242/150 R

(58) Field of Classification Search
USPC ..... 242/419, 419.4, 484.6, 484.8, 484.9, 242/485, 485.1, 485.5, 485.6, 486.6, 486.7, 242/486.8, 487.1, 487.6, 578–578.2, 597.7, 242/128, 139, 149, 150 R; 112/279, 302
See application file for complete search history.

(56) References Cited

U.S. PATENT DOCUMENTS 223,133 A 12/1879 Hall, Jr.
2,465,466 A 3/1949 Mitchell
4,096,812 A 6/1978 Gegauf
4,588,139 A * 5/1986 Lines ..... 242/483.9
4,646,982 A 3/1987 Spring
4,979,688 A 12/1990 Tinker et al.
5,707,021 A 1/1998 Bitts et al.
5,865,394 A 2/1999 Giese et al.
5,871,163 A 2/1999 Bertoli et al.
6,036,136 A 3/2000 Bobo

FOREIGN PATENT DOCUMENTS

KR 20-0333639 11/2003

OTHER PUBLICATIONS

International Search Report dated Oct. 24, 2012.
Wrights, Side Winder, Good Things Come in Small Packages, 2007 Press Release.

* cited by examiner

*Primary Examiner* — William E Dondero
(74) *Attorney, Agent, or Firm* — Pillsbury Winthrop Shaw Pittman, LLP

(57) ABSTRACT

Disclosed is a portable device for winding thread around a bobbin from a spool of thread. The device includes a height adjustable thread holder configured to receive the spool of thread, a thread guide bar pivotable between a stored position and an operative position, and an adjustable tension feed device for applying tension to the thread during winding. The device also includes a spindle slot configured to receive one of a plurality of rotatable spindles that are interchangeable within the spindle slot so that different corresponding spindles can be used with the device. Also, a speed control knob for adjusting a speed at which the spindle rotates and thus at which thread is wound around the bobbin from the spool of thread, a fill knob for adjusting the amount of thread to be wound on the bobbin, and an automatic shut off mechanism are disclosed.

15 Claims, 8 Drawing Sheets

PORTABLE BOBBIN WINDER

BACKGROUND

1. Field of Invention

The present invention is generally related to a portable winding device, and more particularly, to a portable winding device with adjustable features to accommodate a number of types of bobbins and spools of thread.

2. Description of Related Art

Bobbins are used to feed thread to a sewing machine. Some typical devices for winding thread from a larger spool and onto a bobbin are provided on sewing machines. Such devices, however, require that a user stop work on the sewing machine and/or change the thread being used, and thus can be inconvenient for the user. Other, standalone devices for winding thread are also known.

SUMMARY

One aspect of the invention provides a portable device for winding an amount of thread around a bobbin from a spool of thread. The portable device includes: a body having an upwardly facing wall and including a front side, a rear side, a left side, and a right side forming an enclosure; a lid being pivotally connected to the rear side of the body, the lid being pivotally movable between open and closed positions; at least one latch arranged to secure the lid to the body in the closed position; and a handle constructed and arranged to enable a user to carry the portable device. The portable device also includes an adjustable thread holder, provided on the upwardly facing wall, configured to receive the spool of thread. The adjustable thread holder is adjustable in a vertical direction with respect to the upwardly facing wall. Also, a thread guide bar is provided on the upwardly facing wall and is pivotable between a stored position and an operative position. The thread guide bar has an end with a loop for receiving thread from the spool of thread on the adjustable thread holder. The portable device also has an adjustable tension feed device provided on the upwardly facing wall and for applying adjustable tension to the thread received from the thread guide bar during winding and a spindle provided on the upwardly facing wall configured to receive and selectively rotate the bobbin so as to wind thread received from the spool and the adjustable tension feed device thereon. The enclosure of the body has a motor therein that is configured to selectively receive power from a power source and that is coupled to the spindle to selectively rotate the spindle to wind thread around the bobbin. The upwardly facing wall further has a speed control knob operatively connected to the motor for adjusting a speed at which the spindle rotates in order to adjust a speed at which thread is wound around the bobbin and from the spool of thread.

Another aspect of the invention provides a portable device for winding an amount of thread around a bobbin from a spool of thread. The portable device includes: a body having an upwardly facing wall and including a front side, a rear side, a left side, and a right side forming an enclosure; a lid being pivotally connected to the rear side of the body, the lid being pivotally movable between open and closed positions; at least one latch arranged to secure the lid to the body in the closed position; and a handle constructed and arranged to enable a user to carry the portable device. The portable device also includes an adjustable thread holder, provided on the upwardly facing wall, configured to receive the spool of thread. The adjustable thread holder is adjustable in a vertical direction with respect to the upwardly facing wall. Also, a thread guide bar is provided on the upwardly facing wall and is pivotable between a stored position and an operative position. The thread guide bar has an end with a loop for receiving thread from the spool of thread on the adjustable thread holder. The portable device also has an adjustable tension feed device provided on the upwardly facing wall and for applying adjustable tension to the thread received from the thread guide bar during winding and a spindle provided on the upwardly facing wall configured to receive and selectively rotate the bobbin so as to wind thread received from the spool and the adjustable tension feed device thereon. The enclosure of the body has a motor therein that is configured to selectively receive power from a power source and that is coupled to the spindle to selectively rotate the spindle to wind thread around the bobbin. The upwardly facing wall further includes a fill knob for adjusting the amount of thread that is wound on the bobbin.

In yet another aspect of the invention, there is provided a portable device for winding an amount of thread around a bobbin from a spool of thread. The portable device includes: a body having an upwardly facing wall and including a front side, a rear side, a left side, and a right side forming an enclosure; a lid being pivotally connected to the rear side of the body, the lid being pivotally movable between open and closed positions; at least one latch arranged to secure the lid to the body in the closed position; and a handle constructed and arranged to enable a user to carry the portable device. The portable device also includes an adjustable thread holder, provided on the upwardly facing wall, configured to receive the spool of thread. The adjustable thread holder is adjustable in a vertical direction with respect to the upwardly facing wall. Also, a thread guide bar is provided on the upwardly facing wall and is pivotable between a stored position and an operative position. The thread guide bar has an end with a loop for receiving thread from the spool of thread on the adjustable thread holder. The portable device also has an adjustable tension feed device provided on the upwardly facing wall and for applying adjustable tension to the thread received from the thread guide bar during winding and a spindle slot provided on the upwardly facing wall and configured to receive one of a plurality of rotatable spindles that are interchangeable within the spindle slot. Each rotatable spindle is configured to receive and selectively rotate a bobbin so as to wind thread received from the spool and the adjustable tension feed device thereon, and each rotatable spindle is further configured to receive a corresponding bobbin. The enclosure of the body has a motor therein that is configured to selectively receive power from a power source and that is coupled to the spindle to selectively rotate the spindle to wind thread around the bobbin.

Other objects, features, and advantages of the present invention will become apparent from the following detailed description, the accompanying drawings, and the appended claims.

DETAILED DESCRIPTION OF THE PREFERRED EMBODIMENT(S)

Figure 1:
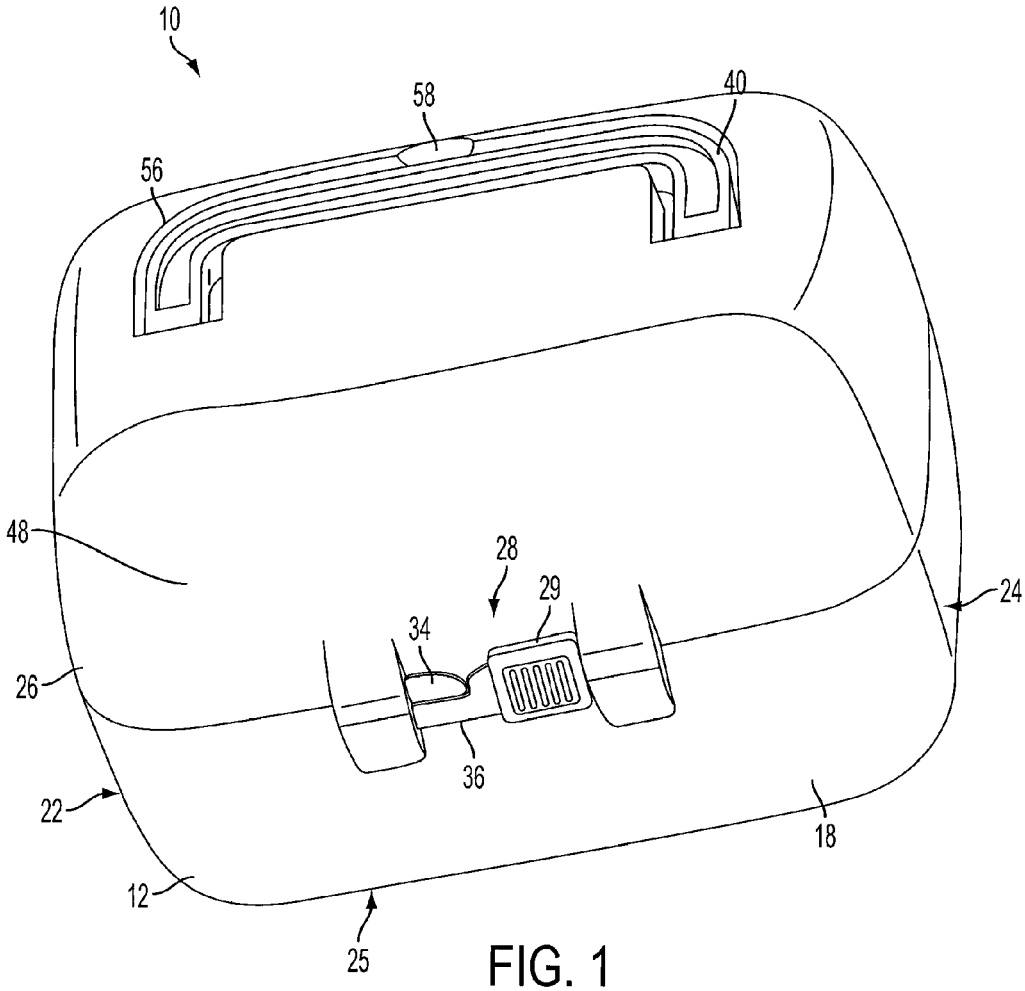
FIG. 1 is an isometric view of a portable device in a closed position for winding an amount of thread around a bobbin in accordance with an embodiment of the present invention.

Referring now more particularly to the drawings, FIGS. 1-8 show a portable, self-contained winding device 10 for winding an amount of thread around a bobbin from a spool. Portable device 10 comprises a body 12 and an interior space 14 defined by an upwardly facing wall 16. Body 12 comprises a front side 18, a rear side 20, a left side 22, a right side 24, and a bottom side 25 that form an enclosure 32. Upwardly facing wall 16 forms a top portion of the enclosure 32 when the portable device 10 is in an open position. As further described later, enclosure 32 comprises devices therein for operating parts provided on upwardly facing wall 16. The bottom side 25 of device 10 may have feet 33 for positioning and supporting body 12 when placed on a surface. For example, feet 33 may include rubber stops to prevent sliding on the surface.

Figures 4, 6:
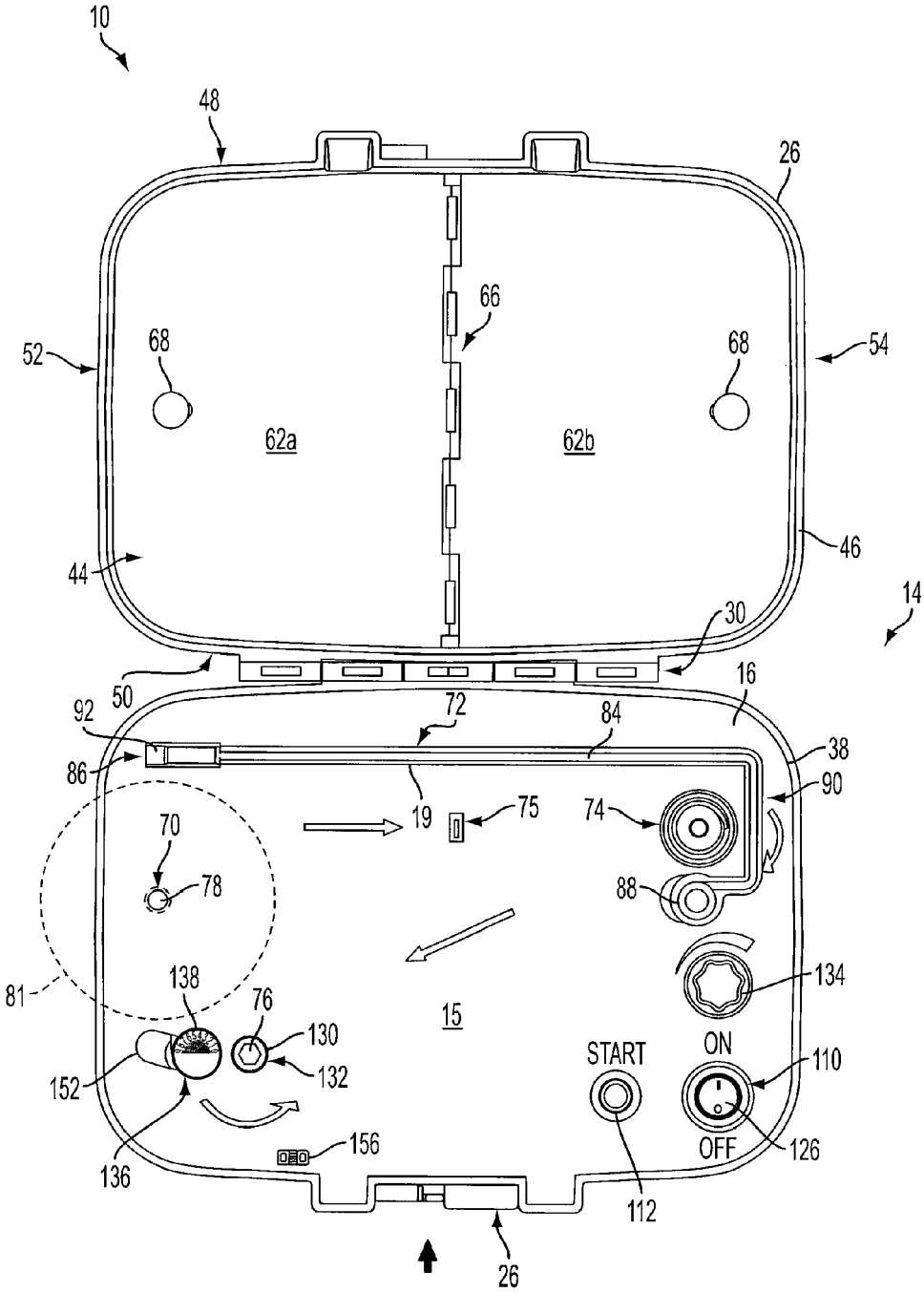
FIG. 4 is a plan view of an inside of the portable device of FIG. 1 in an open position in accordance with an embodiment of the present invention.
FIG. 6 is a detailed view of the parts on top and bottom of a wall of the body of FIG. 4 in accordance with an embodiment.
Figure 5:
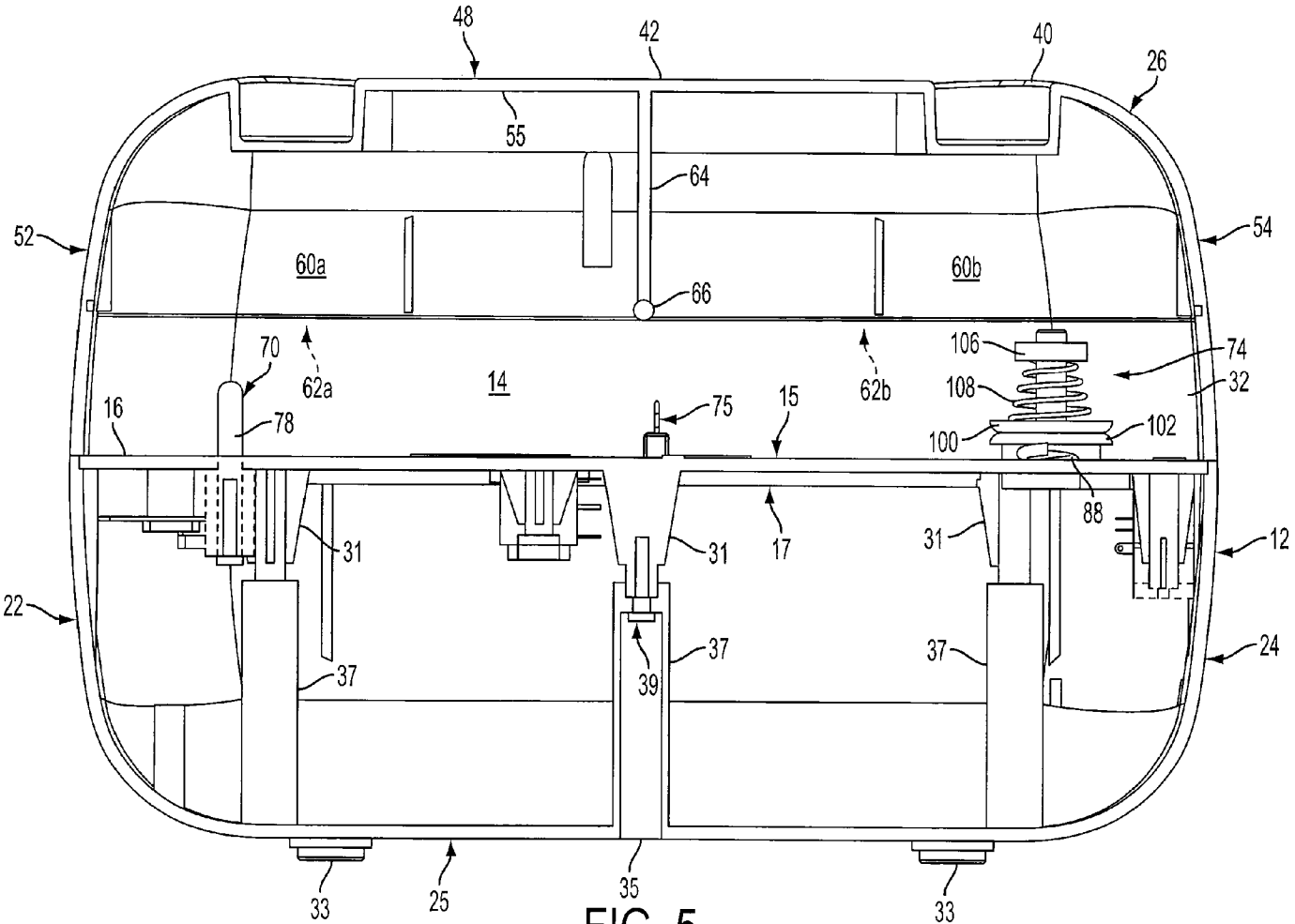
FIG. 5 is a cross-sectional view of the portable device in accordance with the embodiment of FIG. 2.
Figure 6:
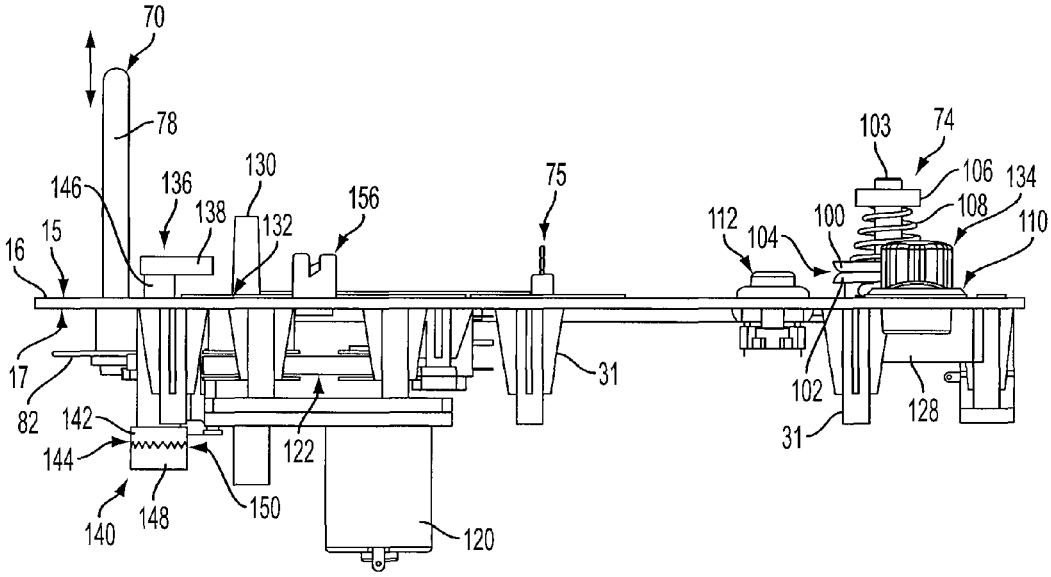

Portable device 10 further comprises a cover or a lid 26 that is pivotably connected to body 12. In the illustrated embodiment, lid 26 is pivotally connected to rear side 20 of body 12. It maybe considered that the side at which the pivot connection is provided (e.g., via a hinge) will be the "rear" side. Lid 26 is pivotally moveable relative the body 12 between an open position (e.g., see FIGS. 3-4) and a closed position (e.g., see FIG. 1), to permit and/or prevent access to interior space 14 and parts on upwardly facing wall 16. Lid 26 may comprise a top surface or side 42 and a bottom surface or underside 44. An edge 46 for connecting with edge 38 of body 12 is provided along a perimeter of lid 26. In an embodiment, a shape of edge 46 is a shape that corresponds to a shape of edge 38, such that edges 38 and 46 can be connected together or engaged with each other. In an embodiment, lid 26 may be of substantially similar shape to body 12, and may comprise a front side 48, a rear side 50, a left side 52, a right side 54, and a bottom side 55, which may or may not form an inner space 60. In an embodiment, lid 26 comprises at least one inner space 60 for objects (e.g., spindles, bobbins) to be stored and transported therein. In an embodiment, the lid 26 also comprises at least one door 62 to form a compartment for selectively closing and securing objects within at least one inner space 60. Each compartment formed by inner space 60 and door 62 may be configured to hold items for use with the portable device 10 and/or related to sewing, for example. FIG. 5, for example, illustrates an exemplary embodiment wherein lid 26 comprises two inner spaces 60*a* and 60*b* therein, separated by a dividing wall 64. A door 62*a* and 62*b* is also provided for each inner space 60*a* and 60*b* (respectively) for selectively securing objects in the compartment. In one embodiment, as illustrated in FIG. 4, each door 62*a* and 62*b* may be pivotally connected to dividing wall 64 via a hinge 66. Also, each door 62*a* and 62*b* may comprise a locking device 68 for securing door with respect to inner space 60 in lid 26. For example, in an embodiment, the locking device 68 may comprise a movable lock element that is configured to lock with respect to an inner (side) wall of the lid 26. To access objects within either inner space 60*a* or 60*b*, the locking mechanism 68 may be moved or pushed away from the side wall (e.g., towards hinge 66) to release the lock element from the side wall. The door 62*a* or 62*b* may then be pivoted about its hinge 66 to provide access to a corresponding inner space 60*a* or 60*b*.

Door(s) 62 need not be pivoting. For example, the door(s) may be configured so as to slide within the hollow interior. In an embodiment, the door is smaller than the inner space 60. In another embodiment, the door is larger. Again, although two compartments are shown, it is to be understood that one, more than one, or no compartments may be formed in the inner space 60 of the lid 26. Also, any number of lids 26 may be provided. In an embodiment, two lids are provided for one storage compartment. For example, a dividing wall 64 may not be provided in inner space 60. In another embodiment, one door 62 is provided for two inner spaces, such that one space may be secured while the other remains accessible. For example, the one door may be configured to slide between left and right sides of the inner space and cover either inner space 60*a* or inner space 60*b*. In yet another embodiment, dividing wall 64 may be provided within lid 26 to form differently-sized inner spaces 60. Accordingly, the configuration of the lid 26 and its parts as described herein should not be limiting.

Figure 2:
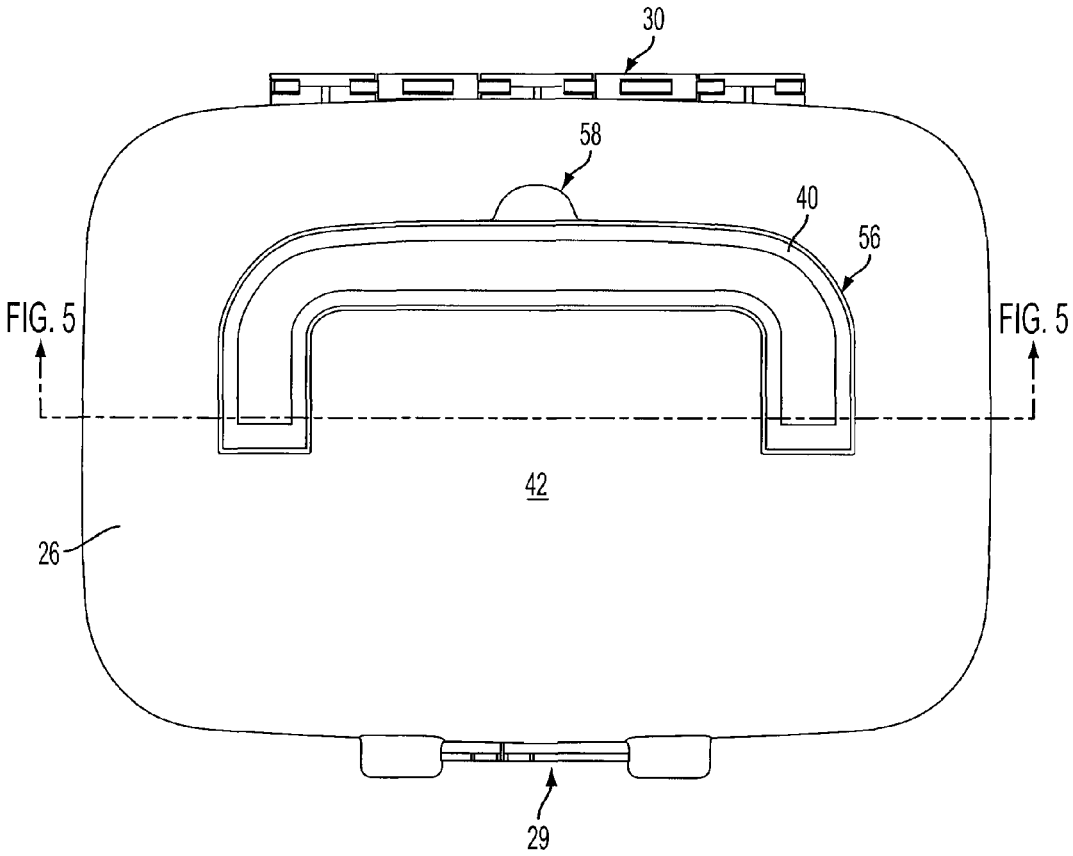
FIG. 2 is a top plan view of a lid of the portable device of FIG. 1.
Figure 3:
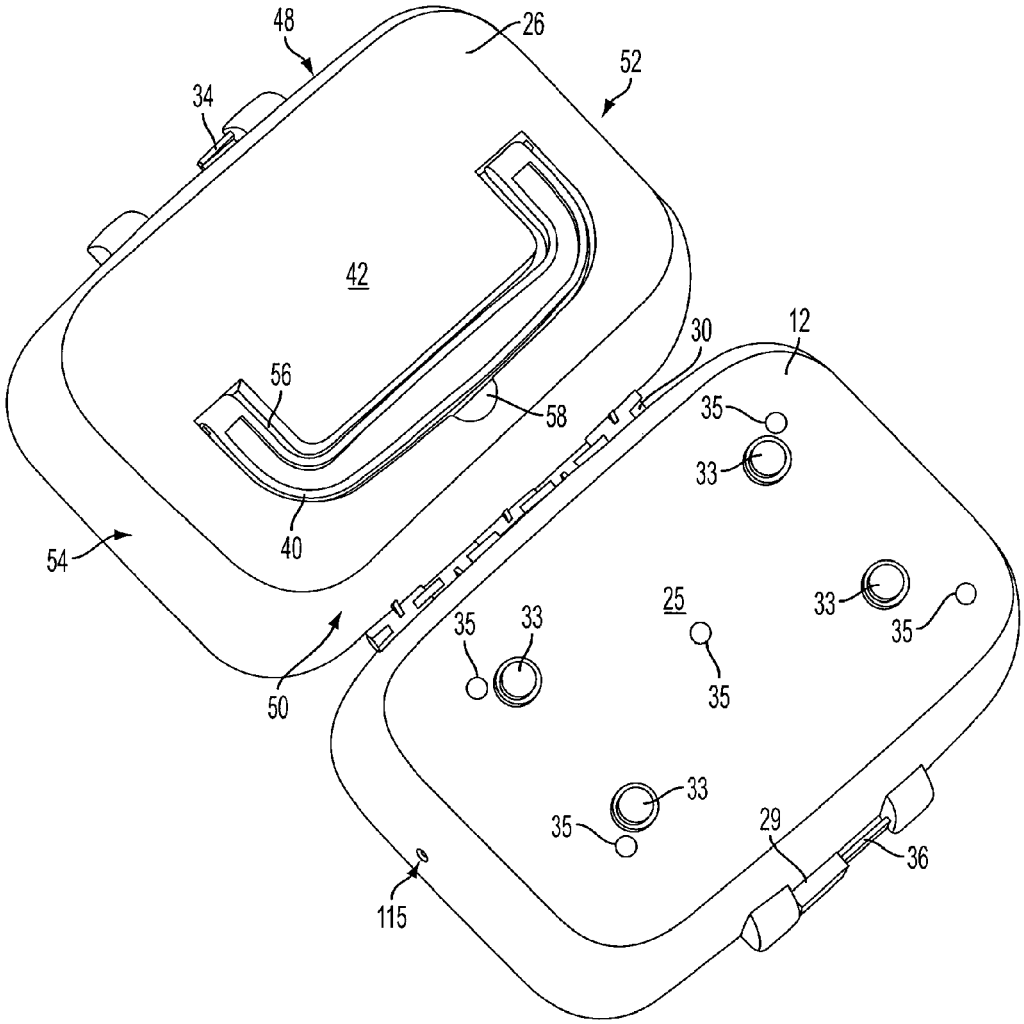
FIG. 3 is an isometric view of the lid of FIG. 2 and a bottom of the portable device of FIG. 1 in an open position in accordance with an embodiment of the present invention.

Portable device 10 may include a handle 40 constructed and arranged to enable the user to lift and carry device 10 and contributes to its portability. FIG. 2 illustrates a top view of lid 26 with handle 40 in accordance with an embodiment. For example, a top surface or wall 42 of the lid 26 may include a depression 56 constructed and arranged to receive handle 40 when handle 40 is not in use. Handle 40 may be formed separately and connected to body 12. In an embodiment, handle 40 may be pivotably attached to top wall 42 of portable device 10. There may be a recessed area 58 adjacent to depression 56 to enable easy grasping of handle 40, for example. When handle 40 is to be used, handle 40 may be pivoted away from the depression 56 to a position wherein handle 40 is generally perpendicular to a plane defined by top wall 42. Handle 40 may optionally be attached to portable device 10 via attachment devices such as pins, hinges, snap-fit connections, or other connecting mechanisms.

One or more hinge structure(s) 30 may be provided that is/are constructed and arranged to enable lid 26 to pivot relative to body 12. Hinge structure(s) 30 may comprise any type of pivotal arrangement, such as, for example, a living hinge, or pins and hoops. In an embodiment, such as illustrated in the exemplary embodiment of FIG. 2, a single hinge structure 30 that substantially extends a horizontal length of the body 12 and lid 26 is provided on portable device 10. In another embodiment, two hinge structures 30 may be provided to connect body 12 and lid 26. Although, in one embodiment, hinge structure(s) 30 may have a permanent connection, a permanent connection is not required. It is contemplated that in some embodiments, a particular hinge structure 30 may be removably connected such that lid 26 and container body 12 may be detached. The methods of mounting lid 26 with body 12 may vary.

Storage container 10 also includes at least one latch 28 arranged to secure lid 26 to body 12 and arranged to secure lid 26 in covering relation with respect to body 12 in a closed position (e.g., see FIG. 1). Each latch 28 is movable between a latched position releasably latching lid 26 in the closed position, and a released position enabling lid 26 to be moved to an open position. In the illustrated embodiment, a slidable latch 28 is provided at a front side of the portable device. However, two or more latches may be provided on any side of the device 10. In the illustrated embodiment, latch 28 comprises a first latch member 34 constructed and arranged on body 12 that aligns with a second latch member 36 constructed and arranged on lid 26 when in the closed position. A slide 29 may be moved (slid or pushed) from a home or unlocked position to a locked position to cover first and second latch members 34 and 36 and lock latch 28, therefore locking movement of lid 26 relative to body 12. In the illustrated embodiment, for example, the slide latch 28 would be pushed from a right side or position to a left side or position. The type(s) of latches used with portable device 10, however, should not be limiting. Also, one or more types of latches may be used on storage container 10.

As previously noted, a number of parts are contained within portable device 10 and are accessible when the portable device 10 is provided in an open position, as shown in FIG. 4. For example, portable device 10 comprises a power (on/off) switch 110 or a plurality of switches to control operation of the portable device 10. The power switch 110 may be provided on a top side 15 of upwardly facing wall 16 of body 14, for example, or anywhere else (e.g., a side wall) on the portable device 10. On/off switch 110 includes a switch module 114 (shown in FIG. 7) mounted on a bottom or underside 17 of wall 16 by fastening devices, and a manually engageable portion 116 that moves pivotally between an ON position and an OFF position (i.e., a rocker switch). The switch module has a movable element (not shown) that connects to the manually engageable portion 116 to move the switch module between its states. Movement of the manually engageable portion 116 of switch 110 moves the switch module between states. In the illustrated embodiment shown in FIG. 7, the switch module connects a motor 120 to the power supply. This connection may be direct or indirect, such as via a controller. In the illustrated embodiment, the motor 120 is operatively connected with a miniature electromagnetic relay 126 and a potentiometer 128. The relay 126 is operatively connected to switch 110 and is configured to relay power to the portable device 10 when switch 110 is moved to an "ON" position. The potentiometer 128 is operatively connected to a speed control knob 134 (further described below) and is configured to adjust an amount of voltage provided to motor 120, so as to adjust a speed of the motor 120 when rotating a rotatable bobbin spindle 76.

In an embodiment, the portable device 10 comprises a start button 112. Start button 112 may be a push button that, when pushed, is configured to power to the motor 120 to thereby rotate the bobbin spindle 76. For example, in such an embodiment, even though a user may turn the power switch 110 to an "ON" position, the motor 120 (and transmission 122) would not rotate the bobbin spindle 76. Once the start button 112 is pressed, power is supplied to the motor and the spindle 76 is rotated for winding thread. Start button 112 allows a user to selectively enable the operation of the portable device 10. Generally, the construction and operation of the switch 110 and devices for controlling a motor are well known, and any construction for these may be used. Further description regarding operation of the bobbin spindle 76 and the portable device 10 is provided below.

Figure 7:
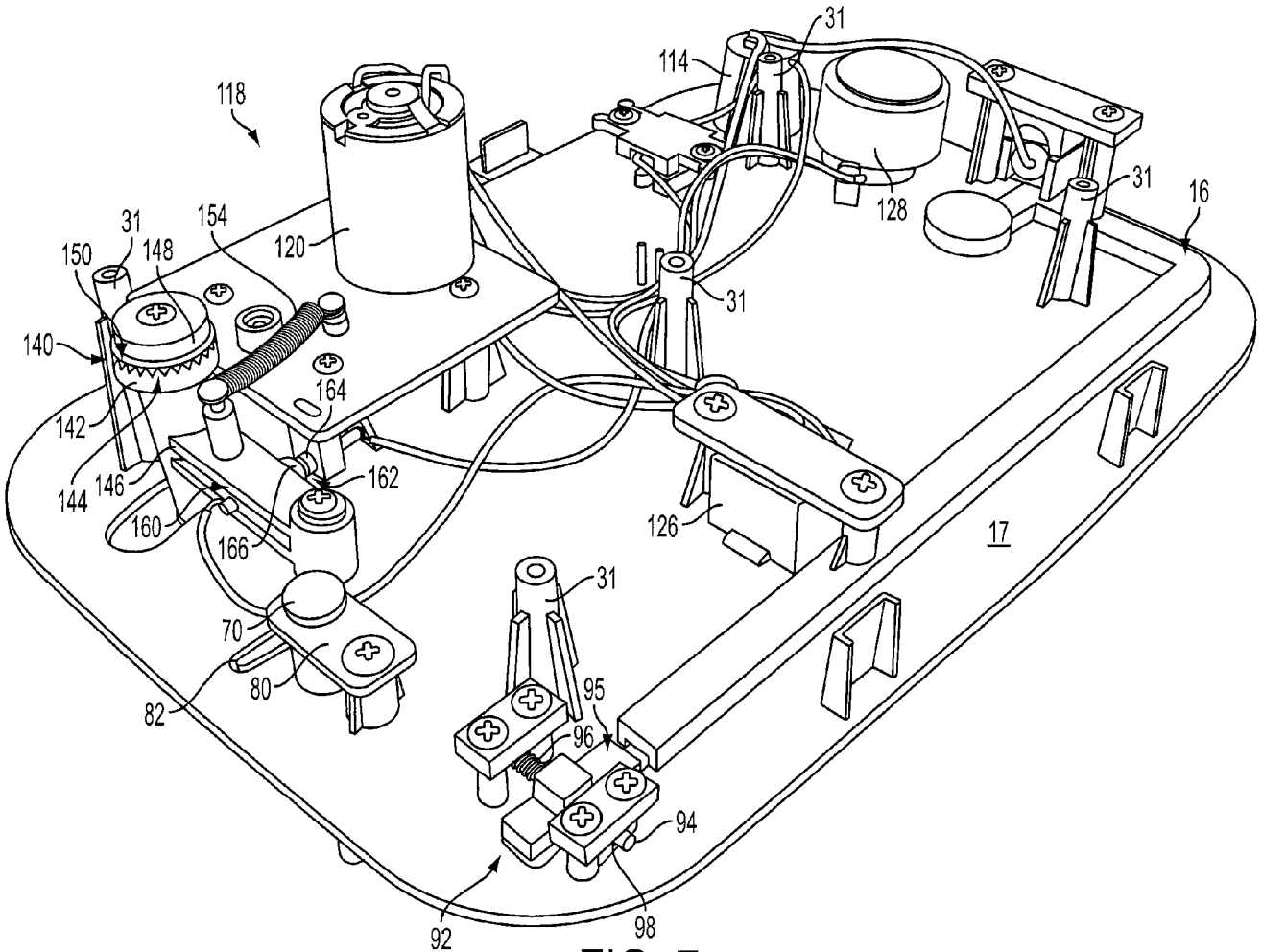
FIG. 7 is an isometric view of the bottom of the wall of the body in accordance with an embodiment.

As previously noted, body 12 comprises enclosure 32 (e.g., see FIG. 5) with devices secured therein for operating parts provided on upwardly facing wall 16. FIGS. 6 and 7 better illustrate the devices mounted on a bottom side or underside 17 of the upwardly facing wall 16 that are operatively connected to parts on the top side 15 of the wall 16 and contained within enclosure 32. For example, enclosure 32 of the body 12 comprises a drive system 118 with motor 120, such as an electrically powered motor, that is configured to selectively receive power from a power source (e.g., via a plug device (not shown) attached via a connection 124 or batteries supplied in a battery compartment (not shown)) and to selectively rotate a bobbin spindle 76 to wind thread around the bobbin. The drive system 118 may have any number of motors and may include one or more transmissions 122. The motor 120 may be an AC induction motor or a DC motor. The motor 120 operates using electrical power to rotatably drive bobbin spindle 76 through a conventional transmission 122 so that thread from a spool is wound around a bobbin.

The portable device 10 may also include a number of frame elements for mounting the motor 120 and transmission 122 of the drive system 118, relay 126, and the potentiometer 128—as well as other devices, also described below—on underside 17 of the wall 16. Generally, devices such as fasteners, screws, or bolts, nuts, or other attachment and/or fastening devices may be used to secure devices to frame elements within enclosure 32 and/or to the underside 17. Additionally and/or alternatively, shock absorbing elements, vibration absorbing elements, and/or springs may be used when mounting such devices.

To enclose the operative parts of the device 10 (e.g., motor 120, transmission 122, wires, etc.) within the enclosure 32, the wall 16 and bottom wall 25 may be configured for connection. For example, as shown in FIG. 5, wall 16 may have one or more connection parts 31 extending therefrom that include a hole or opening for receiving a connection device, such as a screw or rivet (see also FIG. 7). The bottom wall may include one or more holes 35 provided in the bottom wall that provide access to one or more connection parts 37 extending upwardly from the bottom wall 25 (e.g., see FIGS. 3 and 5). The connection parts 37 extend into the body of the device towards the connection parts 31 of the wall 16 such that when the wall 16 is provided in the body 12 the connection parts 31 and 37 substantially align with each other. Specifically, the hole in the connection part 31 may substantially align with a distal hole or opening provided at an end of each connection part. The location of the connection parts 37 may correspond to the location of connection parts 31, or vice versa. A screw, rivet, or other connection device 39 may be inserted into hole 35, through extended body of connection part 37, and into the distal hole so that the connection device 30 can be secured to the hole or opening in connection part 31. Alternatively, other connection devices may be used.

In addition, FIG. 4 shows that top side 15 of upwardly facing wall 16 of body 14 comprises an adjustable thread holder 70, a thread guide bar 72, an adjustable tension feed device 74, and a bobbin spindle 76. The devices 70-76 are used to thread and wind thread from a spool to a bobbin. The adjustable thread holder 70 is configured to receive a spool of thread for feeding thread therefrom and to a bobbin. Adjustable thread holder 70 is adjustable in a vertical direction with respect to the upwardly facing wall 16. In an embodiment, adjustable thread holder 70 comprises a rotationally fixed spool spindle 78 that may be lifted or retracted into body 14 (i.e., into enclosure 32) in order to adjust a height at which a part of the spindle 78 sits above upwardly facing wall 16. The height at which spindle 78 of adjustable thread holder 70 is positioned may be based on a size or height of a spool of thread to be attached thereto. In an embodiment, which is better shown in FIG. 7, a bottom or underside 17 of wall 16 has a mounting piece 80 with a spring 82 therein which is positioned to receive adjustable thread holder 70 and to maintain adjustable thread holder 70 at its selected height or position. For example, spring 82 may be formed such that it applies tension to spool spindle 78 after it is moved and positioned in at a particular height above the upwardly facing wall 16.

Figure 8:
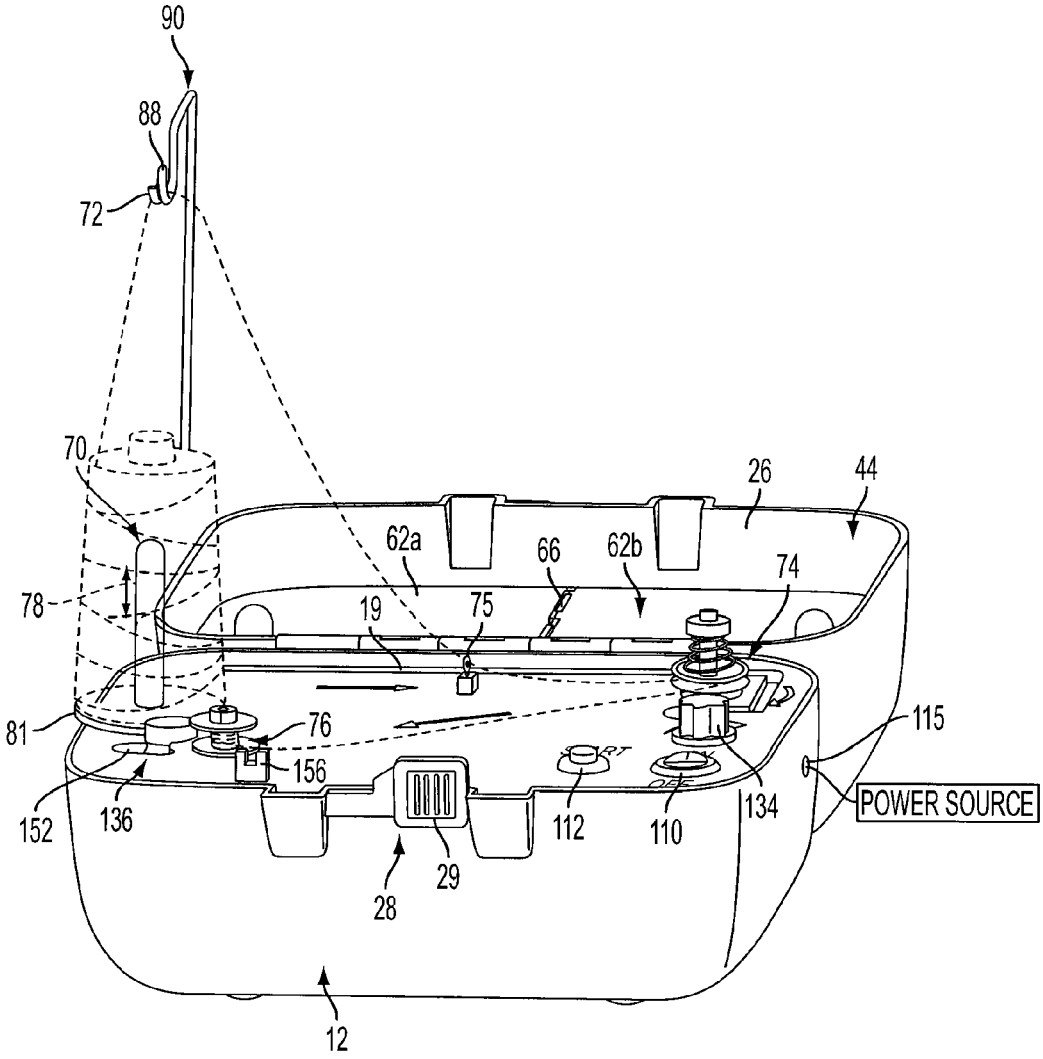
FIG. 8 is an isometric view of the portable device of FIG. 1 in use, in accordance with an embodiment.

In an embodiment, a support 81 may be removably attached to the spindle 78 of adjustable thread holder 70 to support the spool of thread. For example, as shown in FIG. 8, the support 81 is in the form of a pad and is sized to receive a number of spools of thread. In the illustrated embodiment, the pad 81 is configured to be placed over the adjustable thread holder 70 such that it can be slid down the spindle 78 (e.g., through its center hole 82) towards upwardly facing wall 16 and be mounted around the spindle 78. The pad 81 may prevent friction between the spool of thread and the upwardly facing wall 16 during winding, for example. The pad 81 may be formed from a fabric such as cotton or polyester material or other materials. In some implementations, when the pad 81 and spool of thread are mounted on the spindle 78, the pad and spool may extend beyond the body 12 (e.g., see FIG. 8).

Thread guide bar 72 is pivotable between a horizontal, stored position (see FIG. 4) and a vertical, operative position (see FIG. 8). In an embodiment, upwardly facing wall 16 comprises an indented area 19 that corresponds to a size and shape of the thread guide bar 72 to receive thread guide bar 72 therein when in the horizontal, stored position. The thread guide bar 72 may lie substantially on, against, within, or below upwardly facing wall 16 in the horizontal, stored position. When in the operative position, the thread guide bar 72 extends in a vertical direction that is substantially perpendicular to its stored position. Thread guide bar 72 comprises a longitudinal bar 84 with a first end 86 and a second end 90. First end 86 is pivotally connected to upwardly facing wall 16. Second end 90 of bar 84 comprises a bar extending substantially in a perpendicular direction therefrom and has a loop 88 at its end. In an embodiment, the thread guide bar 72 is adjustable in a vertical direction to adjust its height relative to a spool of thread on the adjustable thread holder 70. For example, the longitudinal bar 84 may be a telescopic bar. The loop 88 is configured to receive thread from a spool of thread provided on the adjustable thread holder 70. The longitudinal bar 84 may be pivoted about a pivot connection 92. In the illustrated embodiment, the pivot connection 92 extends through upwardly facing wall 16 and is secured to underside 17 of the wall 16 (see FIG. 7). More specifically, the indented area 19 comprises an opening 21 which allows the pivot connection 92 to extend through and thus be secured by a structure on the underside 17 of the wall 16. The pivot connection 92 comprises a rod 94 and a spring 96 secured within a mounting structure 95. The rod 94 is configured to rotate and move within a slot 98 of mounting structure 95 when the thread guide bar 72 is pivoted between the stored and operative positions. For example, as the thread guide bar 72 is moved to the operative position, the rod 94 rotates within slot 98. As the bar 72 is moved to its vertical and operative position, the rod 94 moves in a horizontal direction within slot 98 and is secured by expansion of spring 96. Spring 96 assists in applying a force on first end 86 and towards mounting structure 95 to temporarily secure the thread guide bar in a vertical, operative position.

Upwardly facing wall 16 also comprises an adjustable tension feed device 74. Adjustable tension feed device 74 is configured to apply adjustable tension to thread received from the thread guide bar 72 (and thus, from spool) during winding. In an embodiment, to further guide thread from loop 88 of thread guide bar 72, an eye 75 is provided on top 15 of upwardly facing wall 16 and extends in an upward direction. The eye 75 is substantially circular in shape. The eye 75 may be positioned substantially between the thread guide bar 72 and the adjustable tension feed device 74.

Any number of devices for applying tension to thread may be used with the portable device. In the illustrated embodiment shown in FIG. 5, the adjustable tension feed device 74 comprises two tension discs 100 and 102 provided on a vertical rod 103 with a channel 104 formed therebetween. The channel 104 receives thread from the spool and the thread is directed around the vertical rod 103 towards a bobbin spindle 76. An amount of tension between the two discs 100 and 102 (and thus applied to the thread wound about rod 103) is adjustable via a rotatable knob 106 and spring 108. Rotatable knob 106 is rotatably mounted to a top end of vertical rod 103 and may be rotated to apply tension to spring 108. Spring 108 applies pressure in a downward direction onto at least tension disc 100. For example, rotatable knob 106 may be turned and rotated clockwise to contract spring 108 and thus spring 108 applies a tension force to tension discs 100 and 102 (e.g., pushing them closer together) and thread within channel 104. To apply less tension to thread, rotatable knob 106 may be turned counterclockwise, thereby allowing spring to expand and apply less force to tension discs 100 and 102.

The rotatable bobbin spindle 76 is configured to receive and selectively rotate a bobbin for receiving thread. The rotatable bobbin spindle 76 is rotated (e.g., via motor 120) in order to wind thread received from a spool thereon. The rotatable bobbin spindle 76 comprises a vertical mounting portion 130 that is inserted and secured within a spindle slot 132 on the upwardly facing wall 16. In an embodiment, vertical mounting portion 130 may be secured in spindle slot 132 via correspondingly-shaped pieces. For example, vertical mounting portion 130 may comprise a male piece with a distinct shape and spindle slot 132 may comprise a female piece with a corresponding and opposite shape to the distinct shape. Bobbin spindle 76 may include a capture device (not shown) in the form of a spring, for example, that extends from the mounting portion 130 and is used to secure a bobbin with respect thereto (e.g., so that a bobbin mounted on the mounting portion 130 can rotate with the spindle 76).

In the illustrated embodiment, the devices 70-76 are configured such that the thread is provided in a path shaped like a "V" for winding. For example, when in operative position for use, the adjustable thread holder 70, thread guide bar 72, and bobbin spindle 76 are positioned adjacent each other on a first side 27 (e.g., a left side) of the top 15 of upwardly facing wall 16, while the adjustable tension feed device 74 is positioned on an opposite, second side 29 (e.g., right side) of the top 15 of upwardly facing wall 16. When a spool of thread and bobbin for receiving thread are provided on the thread holder 70 and bobbin spindle 76, respectively, the path of the thread comprises a substantial "V"-shape (e.g., when viewed from above). The thread is provided from the thread holder 70 and through thread guide bar 72 on the first side 27, directed around the tension feed device 74 on the second side 29, and then directed back to the rotatable bobbin spindle 76 on the first side 27. The "V"-path of the thread in device 10 provides improved tension control of the thread as it is wound from the spool to the bobbin.

In an embodiment, spindle slot 132 is configured to receive one of a plurality of rotatable bobbin spindles 76*a*, 76*b*, 76*c* . . . 76*n* that are interchangeable within the spindle slot 132. Each rotatable bobbin spindle may be configured to receive and selectively rotate a corresponding bobbin so as to wind thread received from a spool thereon. For example, each rotatable spindle may correspond to a differently sized bobbin, a different type of bobbin, etc. Each spindle 76*a*, 76*b*, . . . 76*n* may comprise a vertical mounting portion that is inserted and secured within spindle slot 132 on the upwardly facing wall 16 as well as a capture device (not shown) to secure a correspond bobbin thereto. When a particular spindle is being used, the remaining spindles may be stored in the inner space 60 of lid 26.

In an embodiment, the plurality of spindles may be color-coded according to the bobbins they correspond to. For example, one spindle may be red and corresponds to a first number of types or brands of spindles, while another spindle that is blue corresponds to a second number of types or brands of spindles.

The portable device 10 may also further comprises a speed control knob 134 that is operatively connected to the motor 120 for adjusting a speed at which the rotatable bobbin spindle 76 rotates. As previously described, the speed control knob 134 is configured to adjust an amount of voltage provided to motor 120. The speed control knob 134 is connected to the potentiometer 128 provided on the underside 17 of wall 16. When the speed control knob 134 is rotated, the amount of voltage delivered to the motor 120 by the potentiometer 128 is adjusted (either increased or decreased). This, in turn, adjusts a speed at which thread is wound around the bobbin and from the spool of thread. In the illustrated embodiment, the speed control knob 134 is shown mounted to a second (right) side 29 of the upwardly facing wall 16, adjacent to power switch 110.

In an embodiment, the portable device 10 further comprises a fill knob 136 extending from the upwardly facing wall 16. Fill knob 136 enables adjustment of an amount of thread wound on a bobbin provided on rotatable bobbin spindle 76. Fill knob 136 comprises a rotatable adjustment portion 138 for movement by the user to a plurality of rotational positions that indicates a plurality of predefined positions which correspond to amounts (e.g., thicknesses) at which thread can be wound around a bobbin. In an embodiment, the fill knob 136 is rotatable and operatively connected to a detent mechanism 140 provided within the enclosure 32 (e.g., see FIGS. 6 and 7). For example, rotatable adjustment portion 138 may be connected to a downwardly extending arm 146 having an end 148 with teeth 150. As shown in FIG. 6, the detent mechanism 140 includes a stationary plate 142 that includes a plurality of corresponding teeth 144 thereon. The detent mechanism 140 may be attached to the underside 17 of the wall 16, or any structure that is connected to the wall 16. The teeth 144 of the plate 142 and the teeth 150 of the arm 146 are equally spaced circumferentially. The teeth 150 of the arm 146 are configured to interact with the teeth 144 of the detent mechanism 140 so as to provide the plurality of predefined positions that correspond to a plurality of rotational positions of the rotatable adjustment portion 138, and, hence, a plurality of thicknesses to which bobbin can receive thread. Movement of rotatable adjustment portion 138 causes corresponding movement of the arm 146 relative to detent mechanism 140 for securing the teeth 150 in engagement with teeth 144 at one of the plurality of predefined positions. The detent mechanism 140 thus secures the rotatable adjustment portion 138 of fill knob 136 at a selected position, to thereby define thickness of thread wound around a bobbin.

In an embodiment, movement of the rotatable adjustment portion 138 by the user may provide the user with a tactile, and possibly an audio (e.g., a clicking noise), feedback as the teeth 150 move relative to the teeth 144 of the detent mechanism 140. Thus, the user will actually be able to feel and hear the plurality of predefined positions as the portion 138 is moved. This provides the user with a quick and easy way to incrementally change the thickness of the thread for wounding around the bobbin.

The portable device 10 further comprises a fill capacity mechanism designed to automatically limit and/or shut off power from the power source for rotating the bobbin spindle 76 (via the motor 120) when the thickness of the thread wound around the bobbin reaches its designated or desired fill level (set by fill knob 136). The automatic shut-off or fill capacity mechanism allows consumers to control an amount of thread wound on the bobbin. In an embodiment, the fill knob 136 may comprise a lever arm 160 and contact mechanism 162 configured to provide the automatic shut-off. As shown in FIG. 7, fill knob 136 may comprise a pivoting lever arm 160 positioned below the wall 16. Pivoting lever arm 160 extends generally horizontally and is attached to downwardly extending arm 146. A contact mechanism 162 is provided that is connected to the signal devices (motor 120, relay 126, and potentiometer 128) via wiring for communicating therewith. Contact mechanism 162 comprises a first contact portion 164 and a second contact portion 166. First contact portion 164 may be provided on frame elements of underside 17. Second contact portion 166 may be provided on the pivoting lever arm 160. First contact portion 164 is connected via wiring to switch 110. Second contact portion 166 is connected via wiring to switch relay 126.

The portable device 10 further comprises a slot 152 on the upwardly facing wall 16 in which fill knob 136 is configured for movement therein. More specifically, downwardly extending arm 146 is configured to extend through the wall 16 and into enclosure 32, as better shown in FIG. 6. The slot 152 may be a curved slot, (see FIG. 4), for example. Pivoting lever arm 160 connected via a spring 154 to an underside 17 of wall 16 (e.g., either directly or indirectly via frame elements) (see FIG. 7). The spring 154 is configured to position pivoting lever arm 160 in a first position (adjacent the bobbin) within slot 152, such that contact portions 164 and 166 remain in contact with each other so that the portable device 10 is operable.

Actuation of switch 110 and switch 112 send power to the device. While contact portions 164 and 166 are in contact with one another, signals are sent via potentiometer 128 and relay 126 to power motor 120, thereby spinning or rotating bobbin spindle 76. Pivoting lever arm 160 is configured to pivot and move within slot 152 from a first (home) position when thread being wound on the bobbin spindle 76 has reached its desired fill level. For example, as the bobbin spins on bobbin spindle 76, the thickness of the thread being wound therearound gets thicker. Once the thread reaches its desired thickness, it can press against and move fill knob 136 within slot 152, away from its first (home) position. Such movement can cause first and second contact portions 164 and 166 to disconnect, thereby sending a signal to the switch relay 126 (i.e., a lack of signal, or no signal, being received via second contact portion 166). The switch relay 126 and potentiometer 128 communicate via connecting wires to stop the motor 120 from being powered, thus automatically stopping the winding of the bobbin on the bobbin spindle 76.

The illustrated embodiment of the fill knob 136 and the described fill capacity and automatic shut-off mechanism is not intended to be limiting in any way. For example, the location of the contact portions 164 and 166 and/or use of pivoting lever arm 160 as part of the device should not be limiting.

The portable device 10 may further comprise a thread cutter 156 on the upwardly facing wall 16 in accordance with an embodiment. The thread cutter 156 may extend vertically from the wall 16. The thread cutter 156 comprises a cutting element 158 that is configured to cut thread when thread is inserted into the thread cutter 156 and forced against cutting element 158. For example, thread that is fed from the spool to the bobbin may be cut by thread cutter 156 after the bobbin is wound to its desired fullness or thickness so that the bobbin may be removed from the rotatable bobbin spindle 76.

To use the portable device 10, a user may first slide latch 28 on the front side 18, 48 of the machine from a latched position to a released position (e.g., to the right) and open the lid 26 by pivoting about its hinge 30. The lid 26 can open and rest on a surface or table, as shown by the portable device 10 in an open position and prepared for use (for winding thread around a bobbin from a spool) in FIG. 8. A corresponding rotatable bobbin spindle 76 for a user's bobbin may be selected from a plurality of bobbin spindles. The selected bobbin spindle is then inserted into spindle slot 132, and the user slides the bobbin onto the selected bobbin spindle 76.

The support or pad 81 may then be placed over the adjustable thread holder 70 and slid down the spool spindle 78. The spool spindle 78 may then be adjusted in a vertical direction to a most extended position and a spool or cone of thread placed over the spool spindle 78. The user can then raise (pivot) the thread guide bar 72 and adjust the height of either/both the thread guide bar 72 or/and the spool spindle 78 to accommodate the type of spool being used. The thread guide bar 72 is centered over the spool or cone of thread. An end of a piece of thread is drawn from the spool and placed through the loop 88 of the thread guide bar 72, through the eye 75, between tensions discs 100 and 102 of adjustable tension feed device 74, and then wound (e.g., a few turns) onto the bobbin on the selected bobbin spindle 76 (e.g., forming a "V"-shaped path). The fill knob 136 may then be adjusted so that the bobbin (when rotated) winds the desired amount of thread around the bobbin.

To power the portable device 10, a power supply cord (not shown) may be inserted into the connection 124 on the side of the machine, and a plug (not shown) is inserted into an outlet, for example. The user may then press the power button 110 towards the "ON" position, followed by pressing the start button 112. The selected bobbin spindle 76 will then be rotated and thread wound around the bobbin. After the bobbin is wound to a desired thickness or fullness, the thread is cut on the thread cutter 156 and the bobbin is removed from the bobbin spindle 76.

If desired, the user may test and adjust the tension on the thread (in the "V" path) before winding the bobbin fully. For example, if needed, the user can adjust the tension on the thread by rotating the knob 106 of adjustable tension feed device 74.

The portable device 10 as herein illustrated and described in the exemplary embodiments is a self contained unit that allows consumers to wind multiple types of bobbins (e.g., sewing machine bobbins, embroidery machine bobbins and longarm quilting machine bobbins) without the use of a sewing machine. The portable device 10 reduces and/or eliminates the frustration of unthreading a sewing machine, winding the bobbin and re-threading the machine. Thus, the portable device 10 makes preparation of bobbins quicker and easier by reducing the amount of time required for set up, and allows for more time dedicated to a user's project. Moreover, the compact size of the portable device 10 makes it easy to store and/or pack for travel and/or for household use.

The construction and configuration of portable device 10 of FIGS. 1-8 as shown is an example and not intended to be limiting. The lid 26, body 12, and/or any other parts of the portable device 10 may be made of plastic, metal, other materials, or any combination thereof. The lid 26, body 12, and/or other parts of the portable device 10 may optionally be made from molded plastic. Also, each of the features described herein may be formed separately or integrally with the structures they are associated with.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A portable device for winding an amount of thread around a bobbin from a spool of thread, the portable device comprising:

a body having an upwardly facing wall and including a front side, a rear side, a left side, and a right side forming an enclosure;

a lid being pivotally connected to the rear side of the body, the lid being pivotally movable between open and closed positions;

at least one latch arranged to secure the lid to the body in the closed position;

a handle constructed and arranged to enable a user to carry the portable device;

an adjustable thread holder provided on the upwardly facing wall and configured to receive the spool of thread, the adjustable thread holder being adjustable in a vertical direction with respect to the upwardly facing wall;

a thread guide bar provided on the upwardly facing wall and pivotable between a stored position and an operative position, the thread guide bar comprising an end with a loop for receiving thread from the spool of thread on the adjustable thread holder;

an adjustable tension feed device provided on the upwardly facing wall and for applying adjustable tension to the thread received from the thread guide bar during winding;

a spindle provided on the upwardly facing wall and configured to receive and selectively rotate the bobbin so as to wind thread received from the spool and the adjustable tension feed device thereon;

the enclosure of the body comprising a motor therein that is configured to selectively receive power from a power source and that is coupled to the spindle to selectively rotate the spindle to wind thread around the bobbin; and wherein the upwardly facing wall further comprises a speed control knob operatively connected to the motor for adjusting a speed at which the spindle rotates in order to adjust a speed at which thread is wound around the bobbin and from the spool of thread.

2. The portable device of claim 1, further comprising a hinge structure constructed to enable the lid to pivot relative to the container body.

3. The portable device of claim 1, further comprising a thread cutter provided on the upwardly facing wall and configured to cut the thread from the spool of thread to the bobbin.

4. The portable device of claim 1, wherein the adjustable tension feed device comprises two tension discs with a channel formed therebetween to receive thread and guide thread from the spool of thread to bobbin.

5. The portable device of claim 1, wherein the height adjustable thread holder, thread guide bar, and spindle are positioned adjacent each other on a first side of the upwardly facing wall, and the adjustable tension feed device is positioned on an opposite, second side of the upwardly facing wall.

6. A portable device for winding an amount of thread around a bobbin from a spool of thread, the portable device comprising:

a body having an upwardly facing wall and including a front side, a rear side, a left side, and a right side forming an enclosure;

a lid being pivotally connected to the rear side of the body, the lid being pivotally movable between open and closed positions;

at least one latch arranged to secure the lid to the body in the closed position;

a handle constructed and arranged to enable a user to carry the portable device;

an adjustable thread holder provided on the upwardly facing wall and configured to receive the spool of thread, the adjustable thread holder being adjustable in a vertical direction with respect to the upwardly facing wall;

a thread guide bar provided on the upwardly facing wall and pivotable between a stored position and an operative position, the thread guide bar comprising an end with a loop for receiving thread from the spool of thread on the adjustable thread holder;

an adjustable tension feed device provided on the upwardly facing wall and for applying adjustable tension to the thread received from the thread guide bar during winding;

a spindle provided on the upwardly facing wall and configured to receive and selectively rotate the bobbin so as to wind thread received from the spool and the adjustable tension feed device thereon;

the enclosure of the body comprising a motor therein that is configured to selectively receive power from a power source and that is coupled to the spindle to selectively rotate the spindle to wind thread around the bobbin; and wherein the upwardly facing wall further comprises a fill knob for adjusting the amount of thread that is wound on the bobbin.

7. The portable device of claim 6, wherein the fill knob is rotatable and operatively connected to a detent mechanism provided within the enclosure, and wherein rotational movement of the fill knob causes movement of the knob relative to the detent mechanism and to the bobbin to adjust the amount of thread that is wound on the bobbin.

8. The portable device of claim 6, wherein the portable device further comprises an automatic shut-off mechanism configured to limit power to the motor from the power source and rotation of the spindle.

9. The portable device of claim 6, further comprising a hinge structure constructed to enable the lid to pivot relative to the container body.

10. The portable device of claim 6, further comprising a thread cutter provided on the upwardly facing wall and configured to cut the thread from the spool of thread to the bobbin.

11. The portable device of claim 6, wherein the height adjustable thread holder, thread guide bar, and spindle are positioned adjacent each other on a first side of the upwardly facing wall, and the adjustable tension feed device is positioned on an opposite, second side of the upwardly facing wall.

12. A portable device for winding an amount of thread around a bobbin from a spool of thread, the portable device comprising:

a body having an upwardly facing wall and including a front side, a rear side, a left side, and a right side forming an enclosure;

a lid being pivotally connected to the rear side of the body, the lid being pivotally movable between open and closed positions;

at least one latch arranged to secure the lid to the body in the closed position;

a handle constructed and arranged to enable a user to carry the portable device;

an adjustable thread holder provided on the upwardly facing wall and configured to receive the spool of thread, the adjustable thread holder being adjustable in a vertical direction with respect to the upwardly facing wall;

a thread guide bar provided on the upwardly facing wall and pivotable between a stored position and an operative position, the thread guide bar comprising an end with a loop for receiving thread from the spool of thread on the adjustable thread holder;

an adjustable tension feed device provided on the upwardly facing wall and for applying adjustable tension to the thread received from the thread guide bar during winding;

a spindle slot provided on the upwardly facing wall and configured to receive one of a plurality of rotatable spindles that are interchangeable within the spindle slot, each rotatable spindle configured to receive and selectively rotate the bobbin so as to wind thread received from the spool and the adjustable tension feed device thereon, and each rotatable spindle further configured to receive a corresponding bobbin; and the enclosure of the body comprising a motor therein that is configured to selectively receive power from a power source and that is coupled to the spindle to selectively rotate the spindle to wind thread around the bobbin.

13. The portable device of claim 12, further comprising a hinge structure constructed to enable the lid to pivot relative to the container body.

14. The portable device of claim 12, further comprising a thread cutter provided on the upwardly facing wall and configured to cut the thread from the spool of thread to the bobbin.

15. The portable device of claim 12, wherein the height adjustable thread holder, thread guide bar, and spindle are positioned adjacent each other on a first side of the upwardly facing wall, and the adjustable tension feed device is positioned on an opposite, second side of the upwardly facing wall.

* * * * *